US007070314B2

(12) United States Patent
Edmonds

(10) Patent No.: US 7,070,314 B2
(45) Date of Patent: Jul. 4, 2006

(54) LIGHT CHANNELLING WINDOW PANEL FOR SHADING AND ILLUMINATING ROOMS

(76) Inventor: Ian Robert Edmonds, 12 Lentara Street, Kenmore, Brisbane, Queensland 4069 (AU)

( * ) Notice: Subject to any disclaimer, the term of this patent is extended or adjusted under 35 U.S.C. 154(b) by 120 days.

(21) Appl. No.: 10/692,791

(22) Filed: Oct. 27, 2003

(65) Prior Publication Data

US 2004/0201977 A1 Oct. 14, 2004

(30) Foreign Application Priority Data

Apr. 10, 2003 (AU) ..... 2003901700
Jun. 25, 2003 (AU) ..... 2003204904

(51) Int. Cl.
*F21V 7/04* (2006.01)
*B26D 3/08* (2006.01)

(52) U.S. Cl. ..... 362/600; 362/602

(58) Field of Classification Search ..... 362/1, 362/31, 326, 330, 333, 339, 600, 331, 341; 359/615, 591, 594, 597, 598, 613; 83/879, 83/880, 882
See application file for complete search history.

(56) References Cited

U.S. PATENT DOCUMENTS

| | | | | |
|---|---|---|---|---|
| 727,979 | A | 9/1903 | Wadsworth | |
| 3,393,037 | A * | 7/1968 | Imai | 359/593 |
| 4,557,565 | A | 12/1985 | Rock et al. | |
| 4,699,467 | A | 10/1987 | Bartenbach et al. | |
| 4,989,952 | A | 2/1991 | Edmonds | |
| 5,295,051 | A | 3/1994 | Cowling | |
| 5,880,886 | A * | 3/1999 | Milner | 359/599 |

* cited by examiner

*Primary Examiner*—Thomas M. Sember
*Assistant Examiner*—Guiyoung Lee
(74) *Attorney, Agent, or Firm*—Berenato, White & Stavish LLC

(57) ABSTRACT

A method for producing a light channelling panel by making an array of angled cuts in a first transparent plastic sheet, making a similarly spaced array of angled cuts in a second plastic sheet, transposing or flipping the second sheet and fixing it in contact with the first sheet to form a panel with an array of internal light channels. Alternatively, by making an array of angled cuts in the surface of a transparent plastic sheet and an array of similarly spaced angled cuts in the opposite surface of the transparent plastic sheet to form a panel with an array of internal light channels. Said light channelling panel when positioned in a window of a building channels substantially all sunlight incident on the panel through the panel and over the ceiling in the building thereby illuminating the building with daylight and shading work areas near the window.

14 Claims, 8 Drawing Sheets

LIGHT CHANNELLING WINDOW PANEL FOR SHADING AND ILLUMINATING ROOMS

BACKGROUND OF THE INVENTION

Glass windows are the conventional means for illuminating rooms with daylight. However, ordinary windows have some disadvantages in respect to natural illumination of rooms. One disadvantage is that daylight does not penetrate very deeply into rooms from ordinary windows. The illumination provided through ordinary windows tends to fall almost exponentially with distance from the window. A second disadvantage of ordinary windows is that direct sunlight entering through the windows will produce areas of very intense illumination in areas close to the window that give rise to thermal discomfort and reflected glare.

Thus, an objective of this invention is a method for producing a thin panel, suited for installation in a window, that channels or redirects all, or a very high proportion of, the sunlight incident from the sky onto the panel, into an upwards direction and over the ceiling of the room being illuminated by the window. This channelling or redirection of all incident sunlight into an upwards direction providing for nearly complete shading from incident sunlight of areas of the room in the vicinity of the window which would otherwise receive intense direct sunlight and providing for natural illumination of areas deep inside the room by diffuse reflection of redirected light off the ceiling.

PRIOR ART

The light shelf is an effective and traditional means of reflecting light through a window deeper into a room and for shading areas near a window. However light shelves are an expensive architectural addition to a building and have a tendency to loose efficiency through the accumulation of dust. Therefore there have been many developments with the aim of providing the lighting and shading effect of a light shelf in a vertical panel form more suitable for installation in a window. Prismatic panels moulded from transparent material have been used for many years in windows to improve the natural illumination of buildings by refracting some light up toward the ceiling. A recent example is U.S. Pat. No. 4,557,565 to Ruck et al. However prismatic panels are deficient in refracting only a proportion of incident light upwards, deficient in refracting the light through a relatively small angle and deficient in dispersing the light which is refracted. The concept of deflecting light by total internal reflection at internal interfaces formed within a panel was invented by Wadsworth in 1903, U.S. Pat. No. 737,979. A method for producing such a panel by laser cutting is U.S. Pat. No. 4,989,952 to Edmonds in 1991.

Such panels are effective in deflecting a fraction of incident light strongly upwards. However such panels are deficient in allowing a significant fraction of incident sunlight to pass through the panel thereby producing reflected glare and thermal discomfort in work areas below the panel. When the internal interfaces in such panels are angled downwards into the room incident sunlight can be deflected into a lower elevation angle and much more deeply into a room. However, as the elevation of incident sunlight decreases the elevation of the deflected light can become negative, that is downward, and sunlight, when deflected, near horizontally and downward, into a room, presents an extremely serious glare problem to occupants.

Thus, a further objective of this invention is to provide a method for producing a thin transparent panel suited to installation in a window which channels all, or substantially all, incident sunlight into an upwards direction thereby providing effective shading to work areas below the panel and eliminating the possibility of sunlight being deflected near horizontally into occupants eyes.

Bartenbach et al U.S. Patent No. 4,699,467 describes a reflective light port formed from upper and lower metallic reflectors. A plurality of such ports arranged one above the other may be installed in a window to reflect sunlight into a room. The method of producing a light port of Bartenbach is deficient in that it is difficult and expensive to produce an array of complex metal reflectors fixed one above the other in a panel at the scale (10 mm thick) suited to installation in a window. Secondly the light ports of Bartenbach are deficient in requiring installation between two transparent panels to prevent accumulation of dust on the reflective surfaces.

Thus a further objective of this invention is to provide a method for producing a light-channelling panel, the reflecting surfaces of which do not accumulate dust.

Cowling, U.S. Pat. No. 5,295,051 (1994), describes a light channel formed from an element of transparent material with an upper and lower reflective surface. Each element being formed by extrusion or moulding, with an array of such light channelling elements to be fixed one above the other to form a thin panel for illuminating rooms.

The method of producing a light-channelling panel of Cowling is deficient in that, at the scale necessary to form a thin (10 mm) panel suited to installation in a window, each light channelling element is about 3 mm high and more than one hundred must be fixed one above the other to form a practical sized panel (about 0.5 m high). Fixing hundreds of small elements together is manually intensive or requires the development of specialised machinery. Alternatively, if a panel containing hundreds of precisely shaped elements is to be formed in one piece by extrusion, the extrusion die and infrastructure for extrusion are both highly specialised and expensive. By the method of Cowling, based on extrusion, it is difficult and expensive to make any variation in the design of a light-channelling panel as extensive and expensive variation of manufacturing tooling is required.

Thus it is a further objective of this invention to provide a method for producing a thin, large area, light channelling panel from readily available and inexpensive sheets of clear plastic by a relatively inexpensive and flexible method suited to the production of both small and large quantities of panel with the capability of quickly varying the light channel design so as to suit different applications; for example, high or low latitude locations, East or South facing windows.

SUMMARY OF THE INVENTION

The present invention provides a method to produce light channels within the body of a transparent panel by making a series of parallel cuts through both sides of a single sheet of clear plastic so as to form an array of light channels in the single sheet. In another embodiment the present invention provides a method for producing light channels within a panel by making cuts through one side of a first sheet of transparent plastic and through one side of a second sheet then transposing the second sheet relative to the first sheet and fixing the face of the transposed second sheet against the face of the first sheet thereby forming a combined panel containing an array of light channels. The light channels so formed channel light from the input face of the panel to the output face of the panel by a combination of refraction at the input face, by total internal reflection at the dielectric to air interfaces formed within the panel by the cuts and by refraction at the output face of the panel.

When installed in the upper part of a window to a room the light channelling panel of this invention channels substantially all sunlight incident on the panel, through the panel, and over the ceiling deep inside the room thereby illuminating, by diffuse reflection from the ceiling, the deep interior of the room while effectively shading areas near the window from intense sunlight.

Embodiments of the invention will now be described with reference to the accompanying drawings.

DETAILED DESCRIPTION OF THE INVENTION

Figure 1:
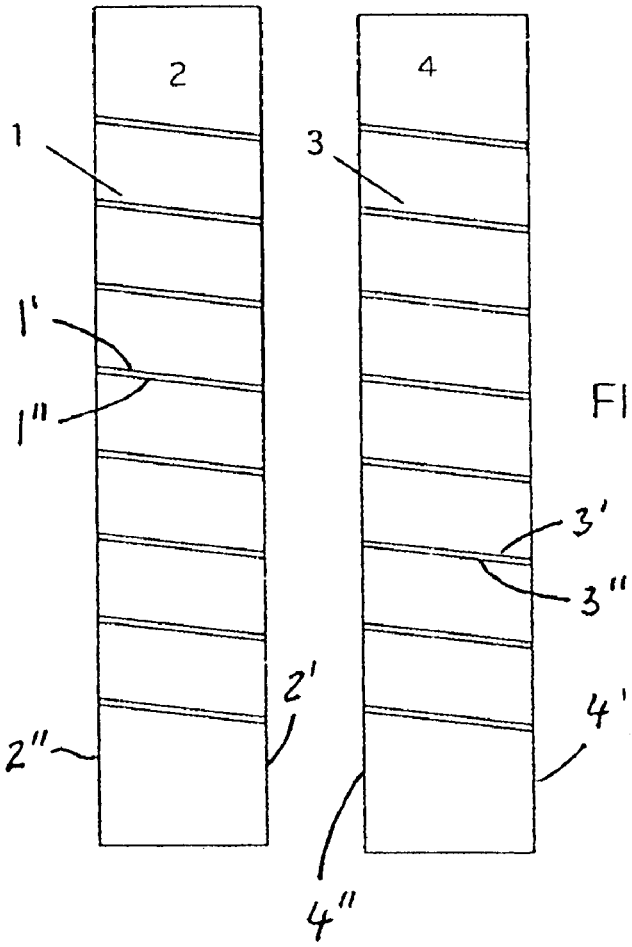
FIG. 1 is a sectional view of a transparent solid sheets of plastic with cuts made right through the sheets at a small angle to the normal to the sheet.
Figure 7:
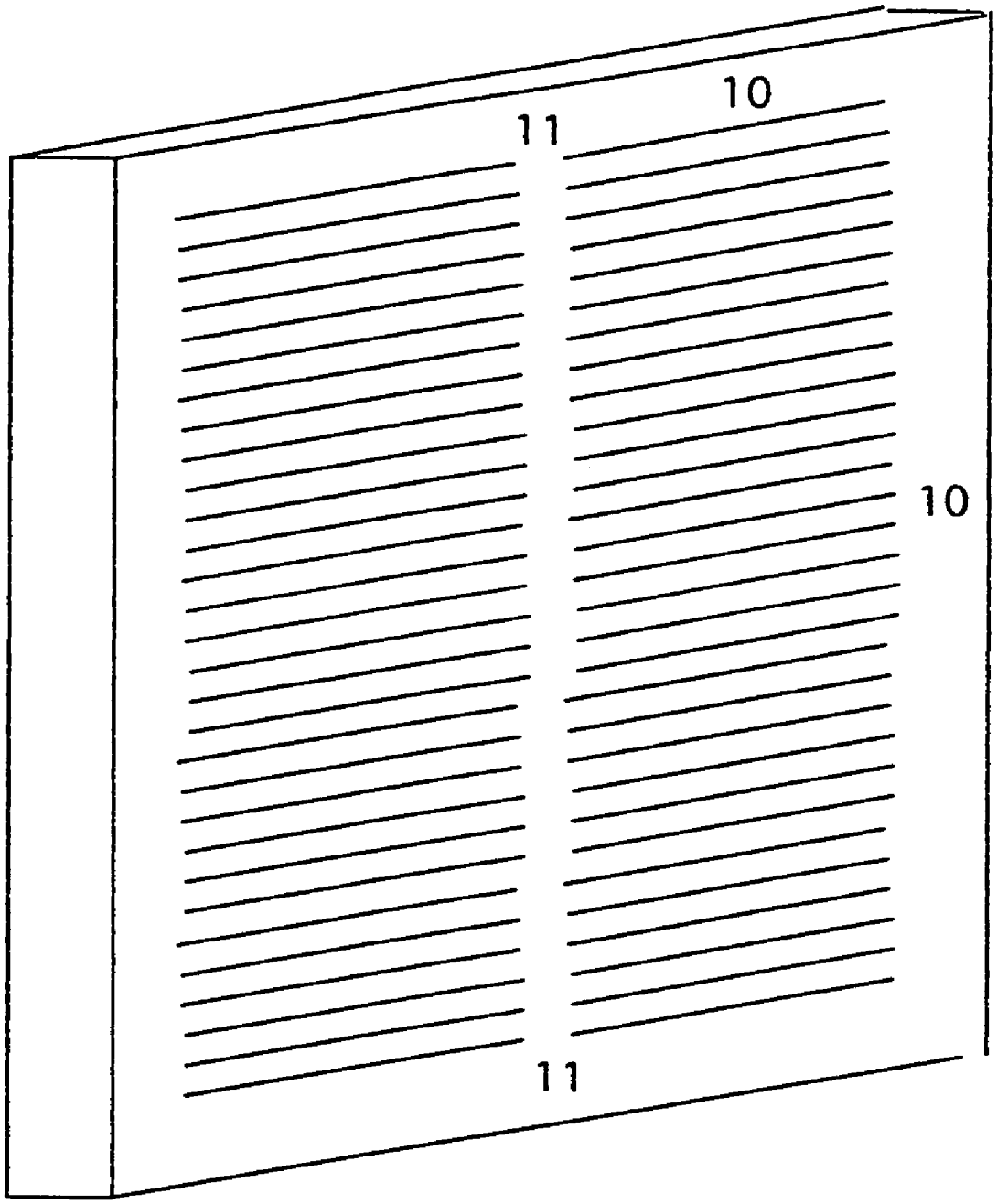
FIG. 7 is a schematic view of a light channelling panel showing the solid continuous border and solid narrow internal column that must be left to support the cut regions when the cuts extend right through the panel.

A first preferred method of producing a light channeling panel 5 of this invention is described with reference to FIG. 1 and FIG. 2 as follows:

(1) By use of a laser cutting machine or a water cutting machine make a parallel array of thin first cuts 1 through a first sheet of transparent plastic 2. The first sheet of transparent plastic 2 has an inner surface 2' and a first surface 2". Each of the thin first cuts 1 has two opposite, substantially parallel walls 1' and 2" extending inwardly from the inner surface 2' of the first sheet 2, as illustrated in FIGS. 1 and 2. The first cuts 1 are made through the first sheet 2 at a specified spacings and at a constant small angle from a normal to the inner surface 2' of the sheet 2 so as to produce the array of first cuts 1 in the sheet 2 as shown in section in FIG. 1. When the first cuts 1 extends right through the first sheet 2 as in FIG. 1 borders and thin internal regions or columns in the sheet are left uncut and solid to support the cut regions, (see FIG. 7).

(2) Make a parallel array of thin second cuts 3 through a second sheet of transparent acrylic plastic 4 with a cutting machine. The second sheet of transparent plastic 4 has an inner surface 4' and a second surface 4". Each of the thin second cuts 3 has two opposite, substantially parallel walls 3' and 3" extending inwardly from the inner surface 4'of the second sheet 4, as illustrated in FIGS. 1 and 2. The second cuts 3 are made through the sheet 4 at the same specified spacings as the first cuts 1 made in the first sheet 2 and at a constant small angle from a normal to the inner surface 4' of the second sheet 4 so as to produce the array of second cuts 3 in the second sheet 4 as shown in section in FIG. 1. The constant small angle from the normal of the second cuts 3 made in the second sheet 4 may be equal to or different from the small angle from the normal of the first cuts 1 in the first sheet 2.

Figure 2:
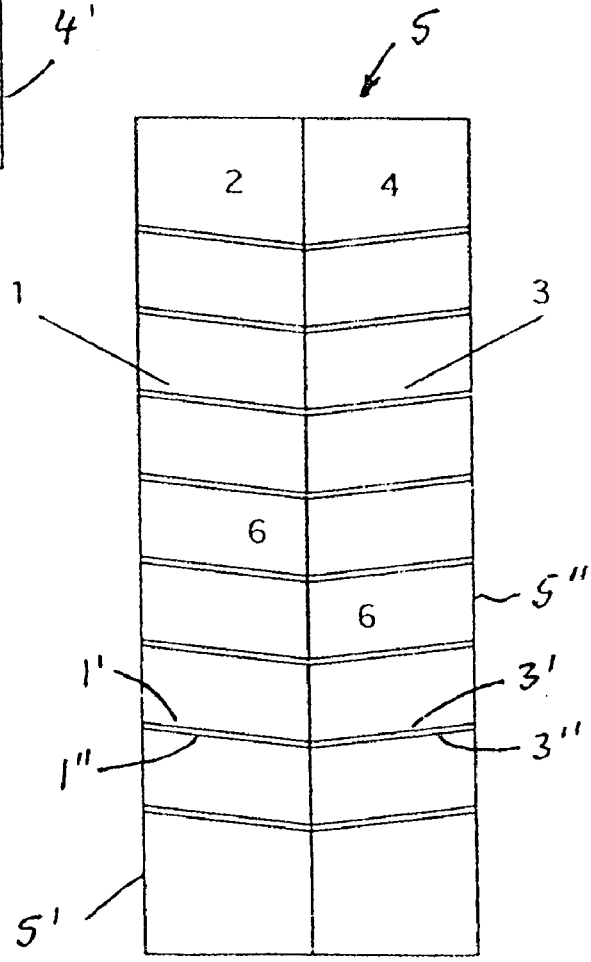
FIG. 2 is a sectional view of a first sheet with angled cuts right through and a second sheet with similarly spaced angled cuts right through. The second sheet having being transposed and fixed in contact with the first sheet to produce light channels within the resulting panel.

Transpose, (that is, rotate through 180°, or flip), the second sheet 4 and fix the inner surface 4' of the transposed second sheet 4 in contact with the inner surface 2' of the first sheet 2 such that edges of the second cuts 3 in the second sheet 4 are collinear or registered with edges of the first cuts 1 in the first sheet 2 so as to form a combined light channeling panel 5 containing an array of light channels 6 as illustrated in FIG. 2. The first surface 2" of the first sheet 2 defines a first (input) face 5' of the light channeling panel 5, while the second surface 4" of the second sheet 4 defines a second (output) face 5" of the light channeling panel 5, as shown in FIG. 2.

A second preferred method of producing a light channeling panel 5*a* of this invention is described with reference to FIG. 3 and FIG. 4 as follows. Elements, which are unchanged from, or function in the same way as in the exemplary embodiment depicted in FIGS. 1 and 2 are labeled with the same reference characters.

Figure 3:
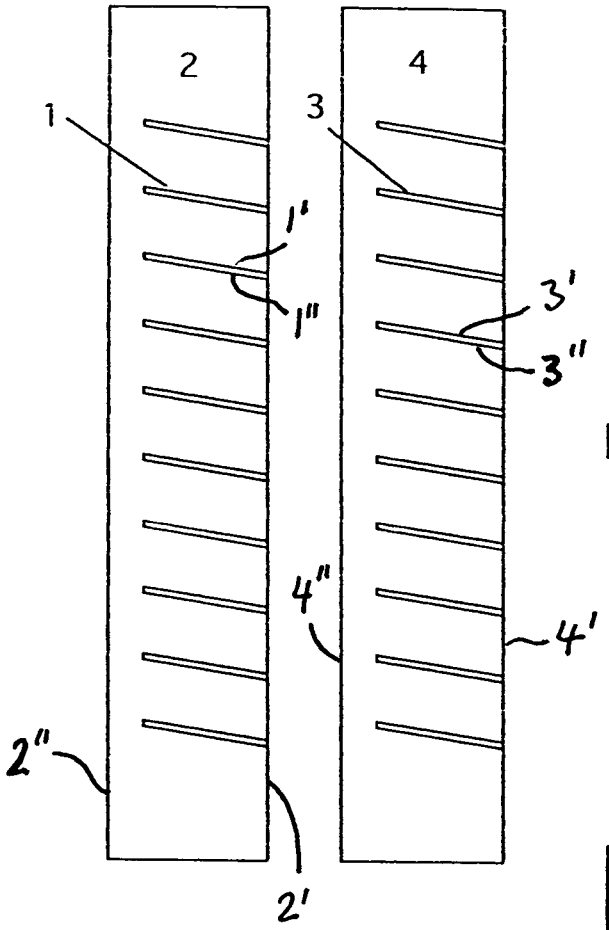
FIG. 3 is a sectional view of a transparent solid sheets of plastic with cuts made partly through the sheets at a small angle to the normal to the sheet.

(1) By use of a laser cutting machine or a water cutting machine make a parallel array of thin cuts 3 partly through a first sheet of transparent plastic 4, the cuts 3 to be made through the sheet 4 at a specified spacings and at a constant small angle from the normal to the sheet 4 so as to produce an array of cuts 3 in the sheet as shown in section in FIG. 3.

(2) Make a parallel array of thin cuts 3 through a second sheet of transparent acrylic plastic 4 with a cutting machine, the cuts 3 to be made partly through the sheet 4 at the same specified spacings as the cuts 1 made in said first sheet 2 and at a constant small angle from the normal to the sheet so as to produce an array of cuts 3 in the sheet 4 as shown in section in FIG. 3. The constant small angle from the normal of the cuts 3 made in the second sheet 4 may be equal to or different from the small angle from the normal of the cuts 1 in the first sheet 2.

Figure 4:
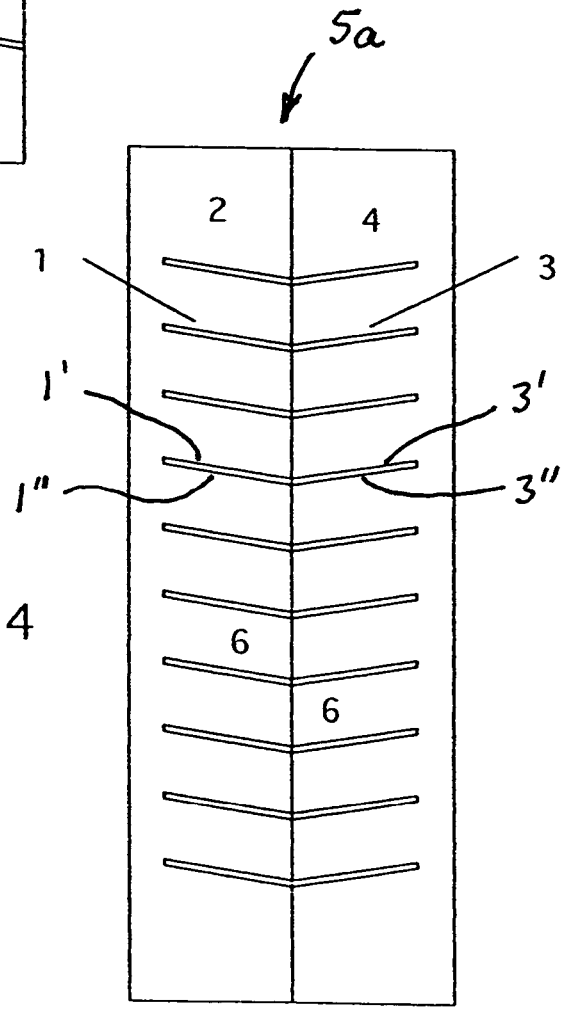
FIG. 4 is a sectional view of a first sheet with angled cuts partly through and 00*a* second sheet with similarly spaced angled cuts partly through. The second sheet having being transposed and fixed in contact with the first sheet to produce light channels within the resulting panel.

(3) Transpose, (that is, rotate through 180°, or flip), said second sheet 4 and fix the surface of the transposed second sheet 4 in contact with the surface of said first sheet 2 such that the edge of the cuts 3 in said second sheet are collinear with edge of the cuts 1 in said first sheet so as to form a combined panel 5 containing an array of light channels 6 as illustrated in FIG. 4.

Figure 4A:
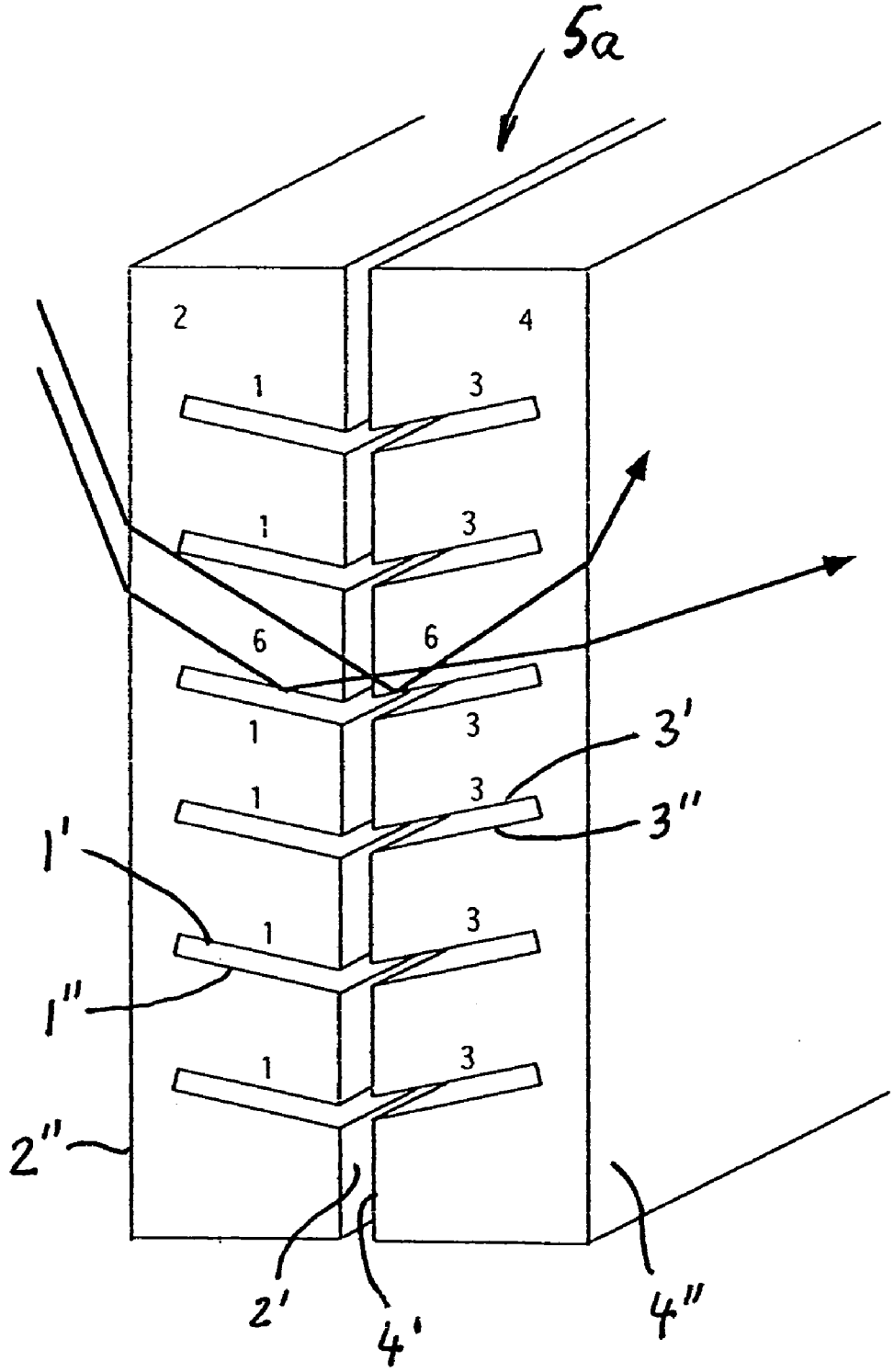
FIG. 4*a* is a schematic view of a first sheet with angled cuts partly through and a second sheet with similarly spaced angled cuts partly through. The second sheet having being transposed and fixed in contact with the first sheet to produce light channels within the resulting panel. For illustrative purposes this drawing shows the two sheets slightly separated.

The light channelling panel of FIG. 4 is shown in a schematic view in FIG. 4*a*. Sheet 2 with cuts 1 and transposed sheet 4 with cuts 3 would, in practice, be fixed together with the surfaces of each sheet in contact. However, in FIG. 4*a*, sheet 2 and sheet 4 are shown with slight separation for the purposes of clarity of illustration. Two light rays are traced through the panel to illustrate how the light channels formed between cuts 1 and cuts 3 form a light channel 6 that channels light by refraction and total internal reflection from the input face of the panel through to the output face.

A third preferred method of producing a light channeling panel 5*b* of this invention is described with reference to FIG. 5 and FIG. 6 as follows. Elements, which are unchanged from, or function in the same way as in the exemplary embodiment depicted in FIGS. 1 and 2 are labeled with the same reference characters.

Figure 5:
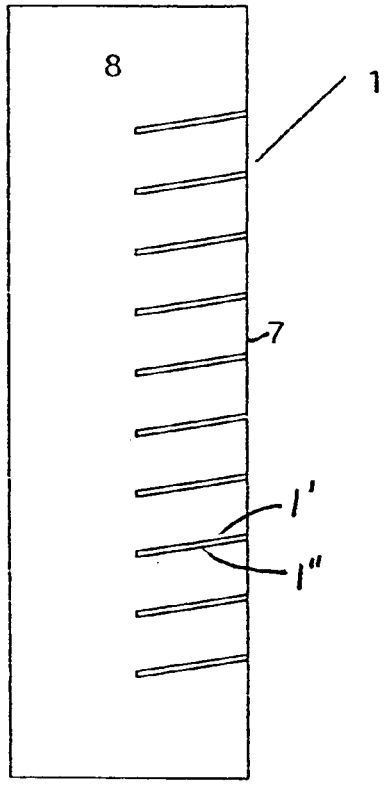
FIG. 5 is a sectional view of a transparent sheet of plastic with angled cuts made partly through the first face of the sheet.

(1) Make a parallel array of thin cuts 1 through the first face 7 of a sheet of transparent plastic 8 with a laser cutting machine or a water cutting machine, the cuts 1 to be made partly through the sheet at a specified spacing and at a constant small angle from the normal to the sheet so as to produce an array of cuts 1 in the sheet as shown in section in FIG. 5.

Figure 6:
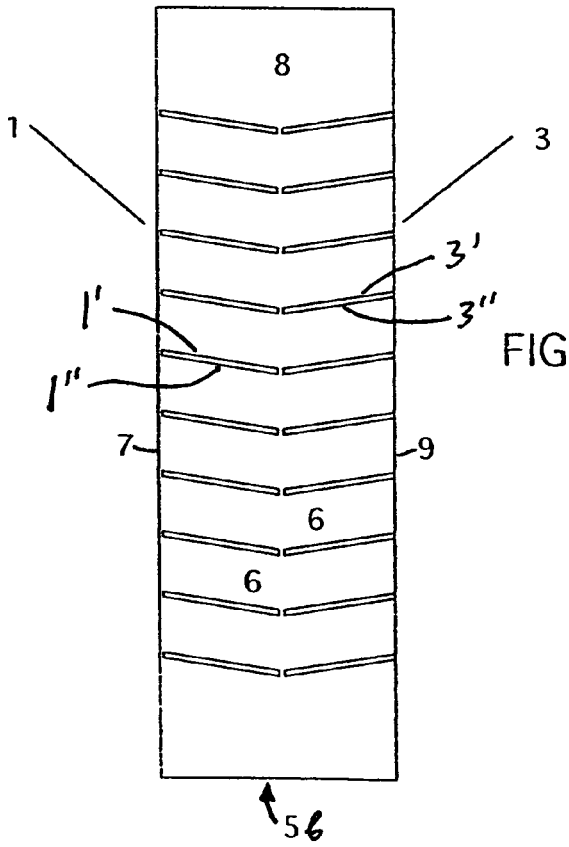
FIG. 6 is a sectional view of a transparent sheet of plastic with equally spaced angled cuts made through both faces of the sheet such that the cuts just meet thereby forming light channels within a transparent panel.

(2) Transpose, (that is, rotate through 180° or flip), said sheet of transparent plastic 8 and by use of the cutting machine make a second parallel array of thin cuts 3 through the second face 9 of said sheet of transparent acrylic plastic 8 with the cutting machine, the cuts 3 to be made partly through the sheet 8 at the same specified spacing as the cuts 1 made through the first face 7 and at the same or a different constant small angle from the normal to the panel so as to produce an array of cuts 3 through the second face which just meet the bottom of the cuts 1 made through the first face 7 so as to produce a light channelling panel containing an array of light channels 6 as illustrated in FIG. 6 suited for the channelling of light from said first surface 7 through to said second surface 9. As the cuts 1 and 3 meet inside the sheet 8 it is necessary to leave a border 10 and thin internal regions 11 uncut and solid to support the cut regions as illustrated schematically in FIG. 7.

Figure 8:
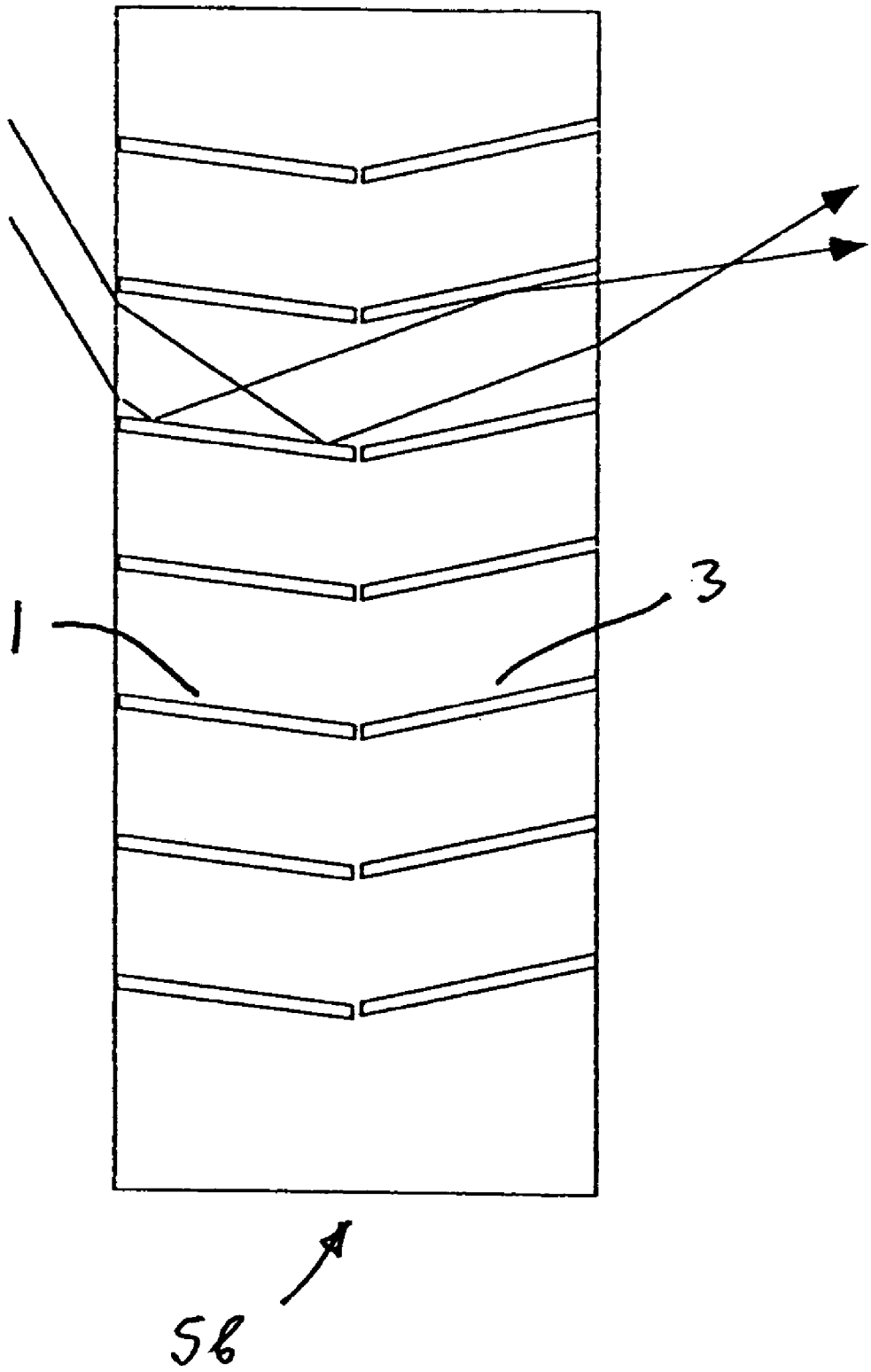
FIG. 8 is a sectional view of a light channelling panel illustrating the channelling of high elevation light through the panel.

As illustrated in FIG. 8 a typical configuration for a light channelling panel of this invention when fixed in vertical orientation in a window opening to a room will channel all, or substantially all, sunlight incident on the first face of said panel by the process of refraction and total internal reflection through to the second face of said panel so that the light emerging from said second face is directed upward into the room.

The typical practical dimensions of the light channelling panels illustrated in FIG. 2 or FIG. 6 would be as follows: overall panel width 12 mm, cut spacing 4 mm, cuts meeting at a depth of 6 mm, angle of cuts on the input side 12° to the normal, angle of cuts on the output side 12° to the normal to the panel face. The typical practical dimensions of the light channelling panel illustrated in FIG. 8 would be: overall panel width 12 mm, laser cut spacing 4 mm, laser cuts meeting at a depth of 6 mm in the panel, angle of laser cuts on the input side 6° to the normal and angle of laser cuts on the output side 12° to the normal to the panel. While these are typical dimensions and typical angles of cut of practical light channelling panels variations of these dimensions and angles fall within the scope of the invention and are to be considered part thereof.

Figure 9:
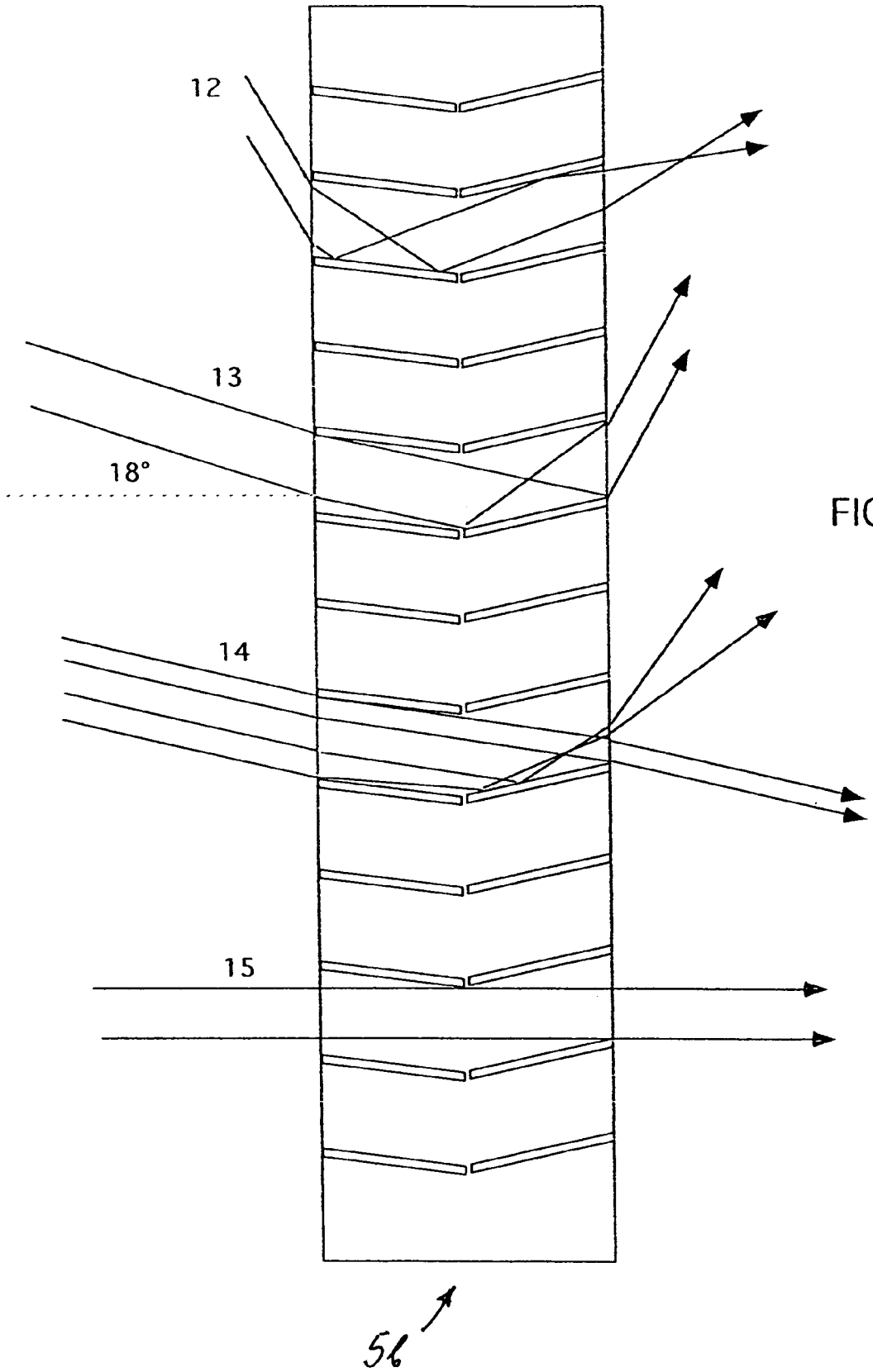
FIG. 9 is a sectional view of a light channelling panel illustrating the wide angular range of elevation in which all incident light is channelled through the panel into an upwardly directed output.

To illustrate the illuminating and shading performance of the light channelling panel in more detail additional ray tracings through a typical example of the light channelling panel of this invention are shown in FIG. 9. The upper set of incident rays, ray group 12 in FIG. 9 show that high angle incident light is channelled through the panel and into a group of rays directed upward at low elevation. The second group of traced rays, ray group 13, show that the minimum elevation angle at which all incident light is channelled into an upward direction is 18° for this particular configuration of light channelling panel. For light incident at angles below 18°, ray group 14, some of the incident light passes directly through the panel thereby providing for an undistorted view through the panel in this direction but at reduced brightness. A fairly large proportion of light incident horizontally, ray group 15, passes directly through the panel, thereby providing good viewing directly out through the panel. It is possible, within the scope of this invention, to alter the principal parameters of the light channelling panel, the cut spacing, the cut depth and the cut angle, to optimise desired performance characteristics. For example, maximising light penetration to the rear of the room by increasing the cut angle of the cuts through the input face, or, increasing the shading effect of the panel to include shading of lower angle light by decreasing the cut spacing.

Figure 10:
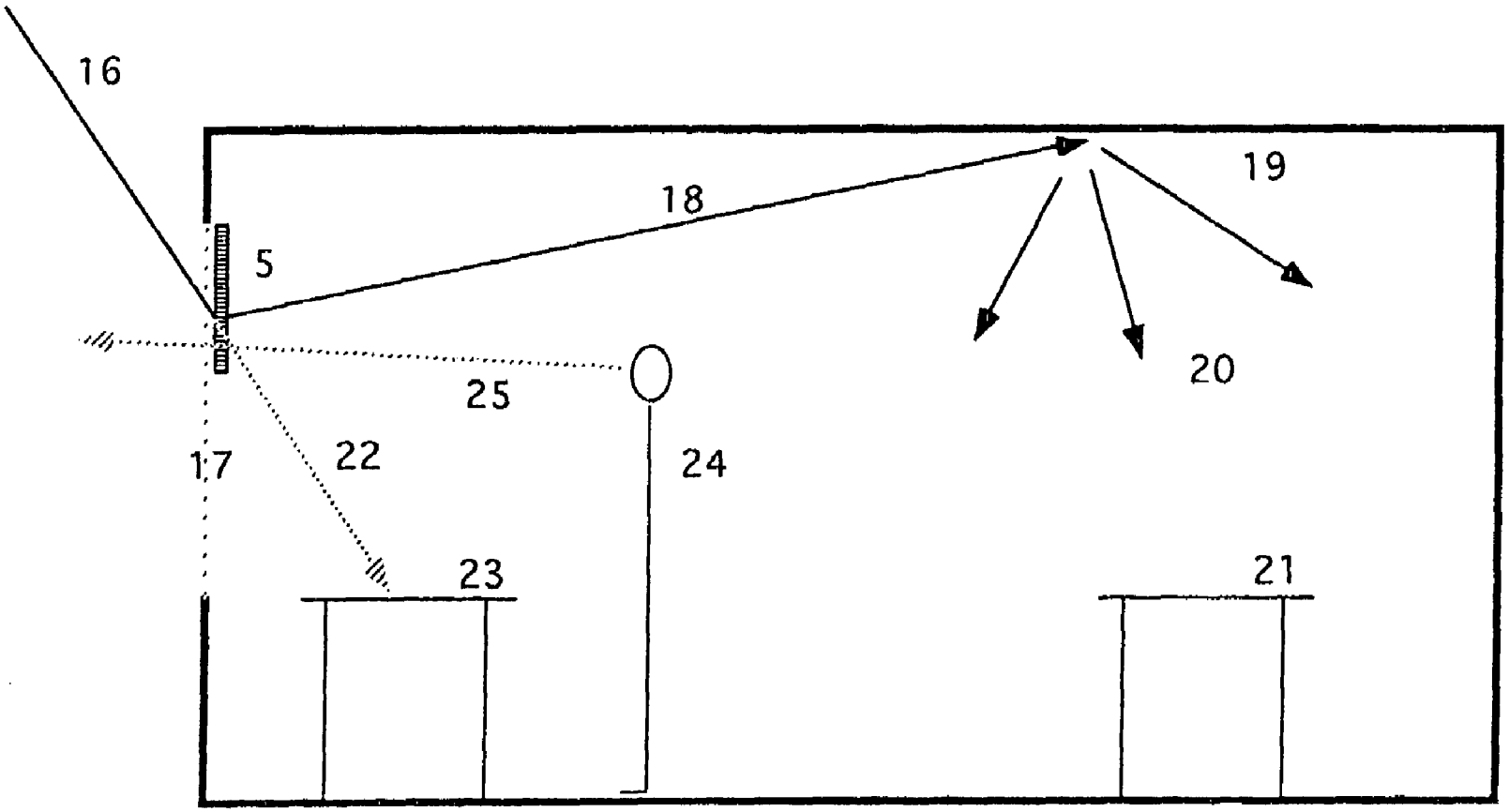
FIG. 10 is a sectional view of a building showing the usual disposition of a light channelling panel in the window, the channelling of sunlight to the ceiling at the rear of the room and the shading of work surfaces near the window. It also illustrates the provision of an undistorted view through the panel in directions near horizontal.

FIG. 10 illustrates the usual positioning of the light-channelling panel of this invention in the window of a room. The panel is usually installed inside the window and in the upper part of the window. However, the embodiment of the light channelling panel illustrated in FIG. 4 may be installed in place of a glass window as this embodiment has solid external surfaces. As shown in FIG. 10, incident light, ray 16, passes through window 17 and is channelled through panel 5 into the direction of ray 18 that penetrates upward and over the ceiling 19 deep in the interior of the room. From the ceiling 19 the light is diffusely reflected into rays 20 to provide illumination to work surfaces 21 deep inside the room. Light rays 22 that would otherwise have intensely illuminated work surfaces 23 close to the window are entirely redirected by the light channelling panel to the ceiling towards the rear of the room. Usually the light channelling panel 5 is installed in the window above eye level of occupants 24 in the room to avoid the possibility of sunlight being directed upwards into occupants view. Occupants 24 generally have a relatively undistorted view to the outside, ray 25, through the light channelling panel provided the viewing direction is near horizontal.

The energy conservation advantages of the light-channelling panel of this invention are considerable. All sunlight incident on the panel is channelled through to the room. However the light channels redirect substantially all sunlight away from the floor and towards the ceiling from where it may be utilised to provide useful illumination in the room. Consider a panel similar to the designs in FIG. 1 through FIG. 9. The panel is 2 m wide and 0.5 m high and is installed in the upper part of a window as in FIG. 10. If sunlight of intensity 1000 W/m$^2$ is incident at 60° elevation on the panel the radiant power channelled through the panel is 2×0.5×

1000×Cos 60°=500 W. Ignoring reflection loss, all of this radiant power is channelled into an upward elevation of about 30° and over the ceiling deep in the room. Ignoring reflection loss at the ceiling all of this radiant power is diffusely reflected downwards to provide useful illumination deep in the room. As the efficacy of sunlight is 105 lumens/W this radiant power is equivalent to 500×105=52,500 lumens of natural illumination. The efficacy of a fluorescent lamp is about 70 lumens/W and a 36 W fluorescent tube provides 36×70=2520 lumens of illumination. It follows from this example that 1 square metre of light channelling panel in a window channels incident sunlight to provide the equivalent illumination of 52500/2520=21 fluorescent lights in the room. If the light channelling panel were not present this 500 W of radiant power would be largely absorbed on the floor, converted to heat and not available for useful illumination. In overcast conditions the useful illumination provided by the panel is reduced to about ⅕ of the value calculated above for direct sunlight.

Those modifications and equivalents which fall within the spirit of the invention are to be considered a part thereof.

I claim:

1. A method for producing a light channeling panel, the method comprising the steps of:

(a) cutting a parallel array of first cuts through an entire thickness of a first sheet of transparent plastic, each of the first cuts having two opposite substantially parallel walls extending inwardly from an inner surface of the first sheet, the first cuts being made with specified spacings therebetween and at a specified angle from a normal to the inner surface of the first sheet and with borders around the periphery of the inner surface of the first sheet and thin internal columns perpendicular to the first cuts left uncut in the first sheet to support cut regions in the first sheet;

(b) cutting a parallel array of second cuts through an entire thickness of a second sheet of transparent plastic, each of the second cuts having two opposite substantially parallel walls extending inwardly from an inner surface of the second sheet, the second cuts through the second sheet being made at the same specified spacings therebetween as for the first sheet and at a specified angle from a normal to the inner surface of the second sheet and with borders around the periphery of the inner surface of the second sheet and thin internal columns perpendicular to the cuts left uncut in the sheet to support the cut regions in the second sheet;

fixing the inner surface of the second sheet in contact with the inner surface of the first sheet such that the edges of the second cuts in the transposed second sheet are collinear with edges of the first cuts in the first sheet, the first and second sheets fixed together so as to form a light channeling panel containing an array of light channels defined between the first and second cuts from a first face of the light channeling panel to a second face thereof that channel light by refraction at the first face by total internal reflection at the cuts and by refraction at the second face.

2. The method as defined in claim 1, wherein the cuts are made with a laser cutting machine in sheets of transparent acrylic plastic.

3. The method as defined in claim 1, wherein the cuts are made with a water cutting machine in sheets of transparent plastic.

4. The method as defined in claim 1, wherein the light channeling panel is fixed in vertical orientation in a window opening to a building to channel substantially all of the sunlight incident on the first face of the panel through to the second face of the panel and upward, into the building, so as to illuminate the building with sunlight reflected diffusely from a ceiling onto work surfaces in the building.

5. A method for producing a light channeling panel, the method comprising the steps of:

(a) cutting a parallel array of first cuts partly through a first sheet of transparent plastic each of the first cuts having two opposite substantially parallel walls extending inwardly from an inner surface of the first sheet, the first cuts being made with specified spacings therebetween and at a specified angle from a normal to the inner surface of the first sheet;

(b) cutting a parallel array of second cuts through a second sheet of transparent plastic each of the second cuts having two opposite substantially parallel walls extending inwardly from an inner surface of the second sheet, the second cuts through the second sheet being made at the same specified spacings therebetween as for the first sheet and at a specified angle from a normal to the inner surface of the second sheet;

(c) fixing the inner surface of the second sheet in contact with the inner surface of the first sheet such that the edges of the second cuts in said transposed second sheet are collinear with edges of the first cuts in the first sheet, the first and second sheets fixed together so as to form a light channeling panel containing an array of light channels defined between the first and second cuts from a first face of the light channeling panel to a second face thereof that channel light by refraction at the first face by total internal reflection at the cuts and by refraction at the second face.

6. The method as defined in claim 5, wherein the cuts are made with a laser cutting machine in sheets of transparent acrylic plastic.

7. The method as defined in claim 5, wherein cuts are made with a water cutting machine in sheets of transparent plastic.

8. The method as defined in claim 5, wherein the light channeling panel is fixed in vertical orientation in a window opening to a building to channel substantially all of the sunlight incident on the first face of the panel through to the second face of the panel and upward, into the building, so as to illuminate the building with sunlight reflected diffusely from a ceiling onto work surfaces in the building.

9. A method for producing a light channeling panel, the method comprising the steps of:

(a) cutting a parallel array of first cuts through a first face of a sheet of transparent plastic, each of the first cuts having two opposite substantially parallel walls, the first cuts being made at specified spacings between the parallel first cuts and at a first specified angle from a normal to the first face of the sheet, the first cuts extending partly through the sheet;

(b) cutting a parallel array of second cuts through a second face of the sheet at the same specified spacings as the first cuts made through the first face and at a second specified angle to the normal to the second face of the sheet, each of the second cuts having two opposite substantially parallel walls, the second cuts through the second face extending partly through the sheet to just meet bottom edges of the first cuts made through the first face with borders around the periphery of the sheet and thin internal columns perpendicular to the cuts left uncut to support cut regions of the sheet, the first cuts through the first face and the second cuts through the second face meeting within the panel so as to form a light channeling panel containing an array of light channels that channel light from the first to the second face by refraction at the first face, by total internal reflection at the cuts and by refraction at the second face.

10. The method as defined in claim 9, wherein the cuts are made with a laser cutting machine in sheets of transparent acrylic plastic.

11. The method as defined in claim 9, wherein the cuts are made with a water cutting machine in sheets of transparent plastic.

12. The method as defined in claim 9, wherein the light channeling panel is fixed in vertical orientation in a window opening to a building to channel substantially all of the sunlight incident on the first face of the panel through to the second face of the panel and upward, into the building, so as to illuminate the building with sunlight reflected diffusely from a ceiling onto work surfaces in the building.

13. The method as defined in claim 9, wherein the first specified angle is substantially the same as the second specified angle.

14. The method as defined in claim 9, wherein the first specified angle is substantially different from the second specified angle.

* * * * *

UNITED STATES PATENT AND TRADEMARK OFFICE

CERTIFICATE OF CORRECTION

PATENT NO. : 7,070,314 B2
APPLICATION NO. : 10/692791
DATED : July 4, 2006
INVENTOR(S) : Edmonds It is certified that error appears in the above-identified patent and that said Letters Patent is hereby corrected as shown below:

Replace column 4 lines 7-21 should read as follows.

(1) By use of a laser cutting machine or a water cutting machine make a parallel array of thin first cuts 1 through a first sheet of transparent plastic 2. The first sheet of transparent plastic 2 has an inner surface 2' and a first surface 2". Each of the thin first cuts 1 has two opposite, substantially parallel walls 1' and [[2]]1" extending inwardly from the inner surface 2' of the first sheet 2, as illustrated in FIGS. 1 and 2. The first cuts 1 are made through the first sheet 2 at [[a]] specified spacing and at a constant small angle from a normal to the inner surface 2' of the sheet 2 so as to produce the array of first cuts 1 in the sheet 2 as shown in section in FIG. 1. When the first cuts 1 extends right through the first sheet 2 as in FIG. 1 borders and thin internal regions or columns in the sheet are left uncut and solid to support the cut regions, (see FIG. 7).

Replace column 4 lines 56-62 should read as follows.

(1) By use of a laser cutting machine or a water cutting machine make a parallel array of thin cuts [[~~3~~]] 1 partly through a first sheet of transparent plastic [[4]]~~1~~ 2, the cuts [[~~3~~]] 1 to be made through the sheet [[4]] 2 at specified spacings and at a constant small angle from the normal to the sheet [[4]] 2 so as to produce an array of cuts [[~~3~~]] 1 in the sheet as shown in section in FIG. 3.

UNITED STATES PATENT AND TRADEMARK OFFICE

CERTIFICATE OF CORRECTION

PATENT NO. : 7,070,314 B2 
APPLICATION NO. : 10/692791
DATED : July 4, 2006
INVENTOR(S) : Edmonds It is certified that error appears in the above-identified patent and that said Letters Patent is hereby corrected as shown below:

Replace Column 5 lines 6-12 should read as follows.

(3) Transpose, (that is, rotate through 180.degree., or flip), said second sheet 4 and fix the surface of the transposed second sheet 4 in contact with the surface of said first sheet 2 such that the edge of the cuts 3 in said second sheet are collinear with edge of the cuts 1 in said first sheet so as to form a combined pane~~l~~[[5]] 5a containing an array of light channels 6 as illustrated in FIG. 4.

Signed and Sealed this

Twenty-first Day of November, 2006

JON W. DUDAS
*Director of the United States Patent and Trademark Office*